US005107636A

United States Patent [19]

Schindele et al.

[11] Patent Number: 5,107,636

[45] Date of Patent: Apr. 28, 1992

[54] MEDICAL EQUIPMENT SUPPORT COLUMN

[75] Inventors: Gary M. Schindele, Kissimmee; Tomio Kato, Temple Terrace, both of Fla.

[73] Assignee: Herman Miller, Inc., Zeeland, Mich.

[21] Appl. No.: 526,106

[22] Filed: May 18, 1990

[51] Int. Cl.[5] ..... E04F 19/00

[52] U.S. Cl. ..... 52/27; 312/209; 312/223

[58] Field of Search ..... 52/27; 312/209, 223, 312/228

[56] References Cited

U.S. PATENT DOCUMENTS

| | | | |
|---|---|---|---|
| D. 248,405 | 7/1978 | Leong . | |
| D. 274,751 | 7/1984 | Brown et al. . | |
| 3,050,194 | 8/1962 | Sinninger . | |
| 3,200,244 | 8/1965 | Meyer . | |
| 3,443,348 | 5/1969 | Papayoti | 52/648 |
| 3,451,738 | 6/1969 | Hobson . | |
| 3,461,349 | 8/1969 | Meyer . | |
| 3,462,892 | 8/1969 | Meyer . | |
| 3,506,138 | 4/1970 | Travis . | |
| 3,756,168 | 9/1973 | Bushyhead . | |
| 3,762,398 | 10/1973 | Schefke et al. . | |
| 4,015,397 | 4/1977 | Flachbarth et al. . | |
| 4,032,821 | 6/1977 | Keiser . | |
| 4,053,193 | 10/1977 | Grover et al. . | |
| 4,164,618 | 8/1979 | Casasanta . | |
| 4,218,579 | 8/1980 | Joly . | |
| 4,252,989 | 2/1981 | Blumenthal . | |
| 4,278,834 | 7/1981 | Boundy . | |
| 4,284,840 | 8/1981 | Baker . | |
| 4,452,499 | 6/1984 | Verburg . | |
| 4,475,322 | 10/1984 | Russo et al. . | |
| 4,479,030 | 10/1984 | Votteler et al. . | |
| 4,544,214 | 10/1985 | Nizel et al. . | |
| 4,600,175 | 7/1986 | Bell et al. . | |
| 4,610,118 | 9/1986 | Fullenkamp . | |

*Primary Examiner*—David A. Scherbel

*Assistant Examiner*—Creighton Smith

*Attorney, Agent, or Firm*—Varnum, Riddering, Schmidt & Howlett

[57] ABSTRACT

A medical service support column for use in hospitals and other medical facilities comprises a pair of open center side frames extending vertically from a rectangular base. The side frames are provided with mounting channels along external edges for mounting support rails extending generally horizontally at adjustable vertical positions along the front, back and sides of the medical support column. Shelves, utility baskets and medical devices for use with a patient are attached to the support rails by clamps at convenient horizontal positions. Electrical power outlet panels are supported along the front and back sides of the column. Spaced-apart upper and lower shelves are supported on cross members extending between the side frames along the front and the back of the structure, and are used to support medical equipment. An open area is defined between the side frames and above the lower shelf which enhances visible and audible communication as well as pass-through capability between persons positioned on opposite sides of the column. The vertically adjustable support rails and medical equipment attached thereto present partial obstructions to the view but are readily adjusted to allow sufficient open area for communication. Shelves and other devices are supportable on inner as well as outer edges of the rails, allowing medical equipment to be supported within the space between the frames. A substantially flat medical gas supply rail for housing several gas lines side by side in a horizontal plane, extends in the open area between the side frames to provide multiple gas supply outlets with minimal visual obstructions through the open area. Rectangularly-shaped housings for containing gas pipes and electrical wiring are positioned adjacent to the side frames and oriented to provide minimal obstruction to view through the open area between the side frames.

20 Claims, 6 Drawing Sheets

MEDICAL EQUIPMENT SUPPORT COLUMN

BACKGROUND OF THE INVENTION

One present invention relates to medical service support columns for use in hospitals and other medical facilities and particularly to a service support column arranged to promote communication between persons working on opposite sides of the column.

Sophisticated medical support equipment is increasingly required in medical facilities in the immediate vicinity of the patient. This is particularly true in such special care units as cardiac care, critical care, and intensive care units. Furthermore, in many medical procedures a number of specialists may be in attendance requiring access to the equipment while at the same time requiring both visual and oral communications with other specialists.

The need for devices which can support medical equipment and provide electrical outlets and medical gases in the proximity of a patient in hospitals has been long recognized. A number of prior art systems exist in the form of medical wall panels which contain electrical and gas outlets and support medical and electrical equipment. Such wall panels usually are permanently mounted on a wall, generally at the head of the patient's bed, and are often difficult to reach, especially when a number of specialists are engaged in a procedure at the same time. Other medical equipment supports comprise columns which support equipment on fixed closely spaced shelving or in enclosed compartments, thereby obscuring a line of vision between persons working on opposite sides of the column. Other support columns place equipment at a relatively low level below the normal line of vision, where it is difficult to observe monitoring screens. One particular medical support column is disclosed in U.S. Pat. No. 4,475,322 having a see-through section with a lower portion of the column supporting electrical equipment and an upper portion supported by a post. The upper portion is anchored to the ceiling and provides connection for electrical and gas supply lines extending through the vertical post. One distinct disadvantage of this prior art see-through arrangement is that medical equipment needed during a procedure is housed below the normal line of vision and is therefore difficult to read and to adjust.

SUMMARY OF THE INVENTION

In accordance with this invention, these and other disadvantages of the prior art are overcome by means of a support column structure comprising a pair of vertically extending side frames having open center areas, and connected by cross members. In accordance with one aspect of the invention, vertically extending, generally parallel mounting channels are attached to the side frames on which support rails are slidably supported. Various pieces of medical equipment or devices, shelves or containers may be attached to the rails along the four sides of the support column structure and in the open space between the side frames. Advantageously, the support rails may be adjusted for convenient vertical positioning of the medical equipment. In one embodiment of the invention, the side frames each comprise a pair of vertically extending struts and cross members connecting the vertical struts, thereby defining open center areas in the frames. Advantageously, these open areas enhance oral and visual communications and provide a pass-through capability allowing attendants to reach into the center area of the support column. Furthermore, support rails may be mounted on the front and back sides of the support column and extending between the side frames as well as extending between vertical struts of the side frames and may be spaced apart to allow sufficient space between rails and supported equipment for oral, visual and pass-through communication among persons working around the support column. In accordance with one aspect of the invention, the support rails are equipped to support medical devices or shelves on the inward edges of the rails as well as outward edges. Advantageously, this allows equipment such as electronic instruments and utility containers to be supported internal to the open space defined between the side frames as well as external to that space. In accordance with one aspect of the invention, an electrical power rail is attached to the two frames extending horizontally between them to provide electrical power outlets along the front and back sides of the column. The power rail is advantageously provided with a front panel having an outer edge, similar to the outer edges of the support rails, for supporting medical devices.

An electrical wiring housing, for containing electrical wiring extending downward from a ceiling position, extends vertically along one edge of one of the side frames. The housing is advantageously provided with an elongated cross section and positioned adjacent one of the side frames, with the narrower sides of the elongated cross section facing toward the front and rear of the structure, in order to minimally interfere with front to rear communications across the open space between the side frames.

A medical gas feed rail is attached to the two side frames and comprises a plurality of gas lines positioned side by side in a generally horizontal plane. Advantageously, the gas feed rail presents minimal blockage to view from front to back or side to side through the support column structure. A gas pipe housing having an opening communicating with the medical gas supply rail has an elongated cross section to accommodate gas pipes side-by-side and is positioned adjacent one of the side frames to avoid blockage of view in the front-to-back direction across the column structure. In one embodiment of the invention, cross members extending between the side frames along the front and the back sides of the column structure support shelves which may be used to hold medical equipment such as monitors, etc., and other supplies.

In one specific embodiment of the invention, a rail provided with a facia panel incorporating emergency call buttons is mounted between the side frames and is positioned within clear view and easy reach of personnel working near the column structure.

BRIEF DESCRIPTION OF THE DRAWINGS

The invention is described with reference to the drawing in which.

DETAILED DESCRIPTION

Figure 1:
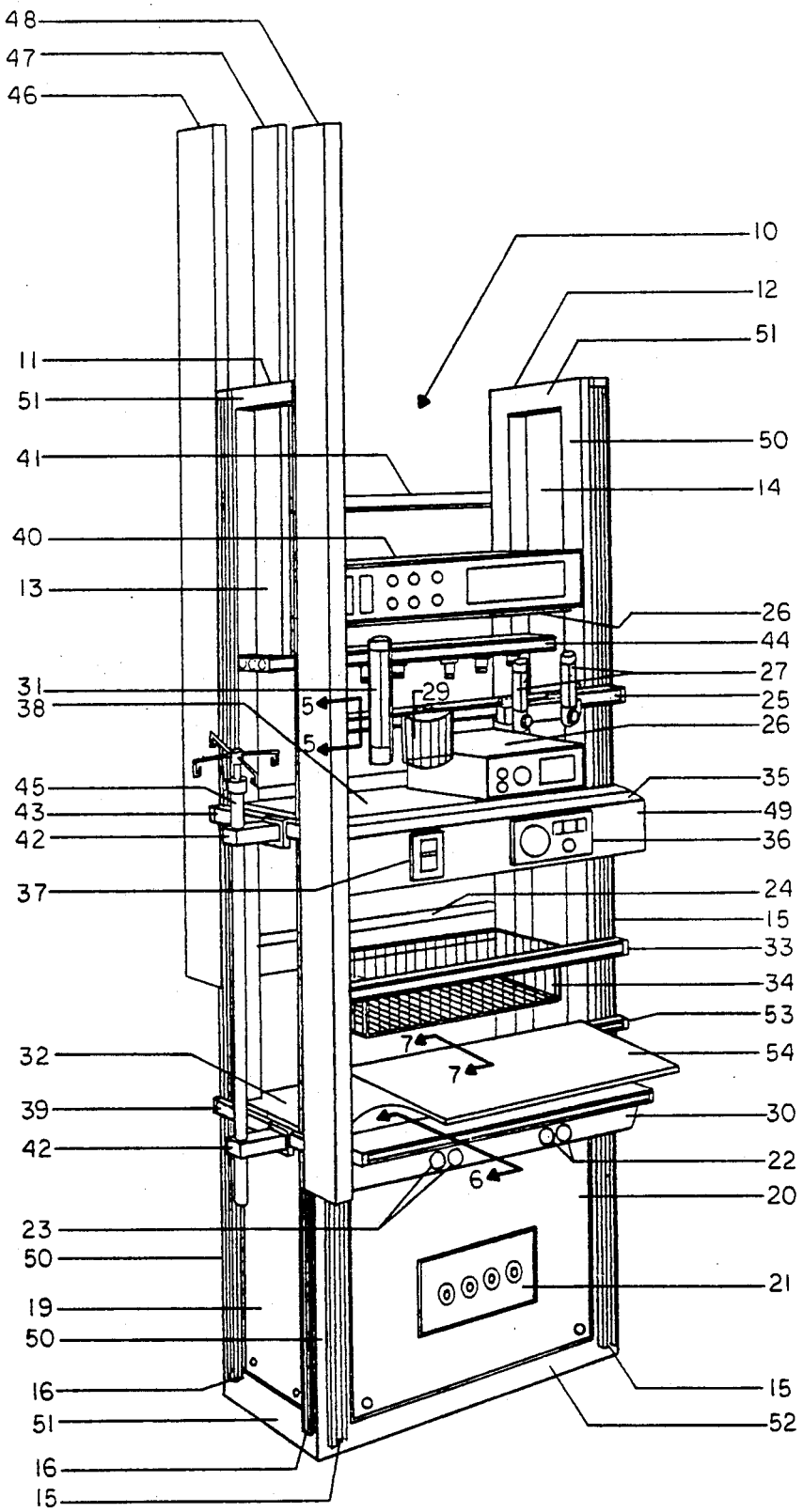
FIG. 1 represents a perspective view of a medical support column in accordance with the invention and displaying medical equipment supported by the column.

FIG. 1, at 10, shows an open-frame medical support column structure in accordance with the invention, comprising a pair of rectangular side frames 11 and 12 having central openings at 13 and 14 respectively. The two side frames are rectangularly shaped and substantially identical, each having a pair of vertically extending struts 50 and having horizontally extending cross members 51 interconnecting the vertically extending struts 50 at the top. The two frames 11 and 12 are interconnected at the bottom of the support column 10 in a rectangular-shaped base consisting of horizontal struts 52 along the back and front sides and horizontal struts 51 along the left and right sides. An open spatial area is defined between the frames for containing medical equipment and facilitating communication among attendants working in the vicinity of the column 10. Central openings 13 and 14 in the side frames further enhance open communication through the column 10.

Mounting channels 15 are attached to outer surfaces of the side frames 11 and 12 and extend vertically along a front facing edge of struts 50 for adjustable attachment of support rails such as 25, 33 and 53. The support rails may be used to adjustably mount support specialized medical instruments and other equipment. For example, flow meters 27, utility basket 29, manometer 31 are shown supported by support rail 25. Any number of different medical devices may be supported in this manner at an easily visible and accessible position. Their vertical position may be readily adjusted by adjusting the support rails in the mounting channels 15. Organizer basket 34 supported by rail 33 is another example of equipment that may be adjustably installed in the support column 10. Similarly, shelf 54 is conveniently supported by support rail 53 external to the support column 10. Monitor 40 is supported near the top of the column on shelf 26, substantially identical to shelf 54. Shelf 26 is supported from a support rail (not shown in the drawing) extending horizontally between frames 11 and 12. The support rails are provided with clamp attachment edges along two edges such that various devices may be supported on the rails internal to the space between the frames as well as external to that space. Shelf 26 is attached to the inner edge of that support rail and extends into the open spatial area between frames 11 and 12.

Figure 5:
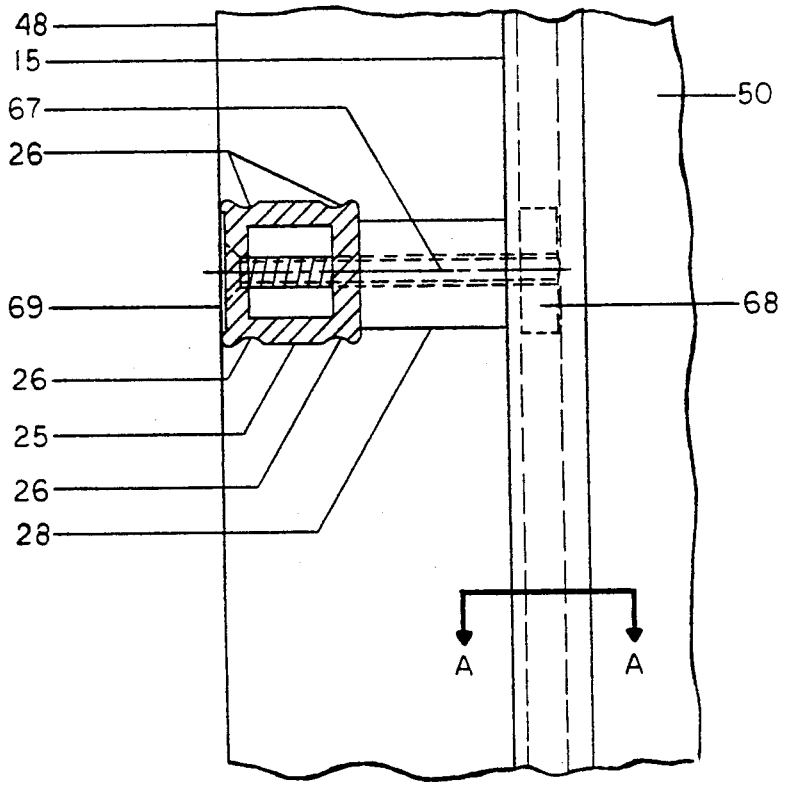
FIG. 5 is a cross-sectional view of a support rail taken along line 5—5 of FIG. 1 showing adjustable attachment to a mounting channel.
Figure 5A:
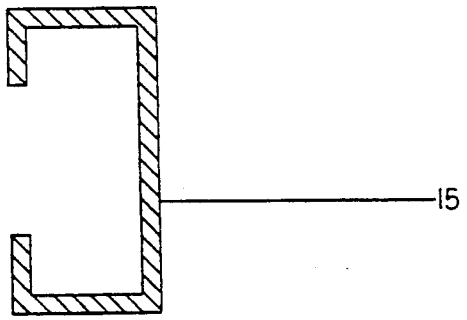
FIG. 5A is a cross section of the channel of FIG. 5 taken along line A—A.
Figure 7:
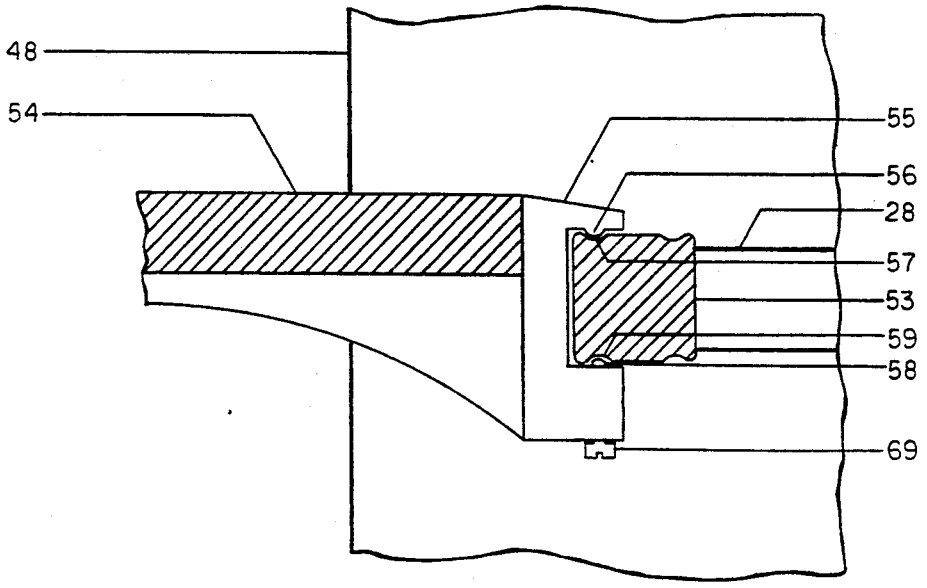
FIG. 7 is a cross-sectional view of a support shelf attachment arrangement taken along line 7—7 of FIG. 1.

FIG. 5 shows a cross section of a support rail 25 taken along line 5—5. Rail 25 is provided with grooves 26 adapted to engage a clamping arrangement similar to clamp 55 shown in FIG. 7. Clamps can be accommodated both at the edge of rail 25 facing toward mounting channel 15 and the edge facing away from mounting channel 15. A spacer 28 positions the r il 25 relative to channel 15 and a flat head screw 67 threaded into lock nut 68 slidably attaches the rail 25 to channel 15. In inlay cover 69 is provided to cover screw 67. FIG. 5A is a cross section of channel 15 taken along line A—A of FIG. 5. FIG. 7 represents a cross-sectional view of support rail 53 and of shelf 54 taken along line 7—7 of FIG. 1. Shelf 54 includes a mounting clamp 55 for attachment to rail 53. Mounting clamp 55 has a rounded ridge 56 adapted to fit in an upper groove 57 of rail 53. An adjustable pin 58, in mounting clamp 55, engages a lower groove 59 of rail 53. Pin 58 may be forced tightly in groove 59 by means of a set screw 69, to secure clamp 55 to the shelf to rail 53. Rail 53 is attached to channel 15 through spacer 78. A variety of mounting clamps may be used to support shelves and other items on the support rails. Clamping arrangements similar to that shown in FIG. 7 are disclosed in U.S. Pat. No. 4,498,693 to E. F. Schindele, issued Feb. 12, 1985; and Des. 252,070 to E. F. Schindele, issued Jun. 12, 1979.

In addition to horizontally extending cross members 51 attached to the vertical struts 50 of the side frames 11 and 12, other frame cross members (not visible in FIG. 1) extend parallel to cross members 51 to interconnect frames 11 and 12 to provide additional strength for the support column structure. These other cross members are used to support shelves 32 and 38. Shelf 38 is shown supporting electronic medical equipment such as a monitor at a readily visible position.

Adjustable mounting channels corresponding to channels 15 may also be provided along the back side of the column structure 10 for supporting bars and equipment in the same manner as described above with respect to devices supported along the front side of the structure. Visible in FIG. 1 is a support rail 41. Edges of the side columns 11 and 12 facing to the left side and right side of the column structure 10 are similarly provided with mounting channels 16 for adjustably mounting equipment as desired. Shown in FIG. 1 is a pair of support rails 39, 43 adjustably positioned in the channels 16 to provide support for a medical device such as an infusion pump holder 45 attached to the bars 39 and 43 by means of mounting clamp 42 similar to clamp 55 shown in FIG. 7.

An electrical outlet panel 30 supplies electrical power from the front side of the column 10. A power raceway 35 has a front panel 49 having an emergency code-blue alarm button 37 and a nurse-call button 36. The outlet panel 30 and raceway 35 may be at a vertical position mounted at a convenient position on the front of the column while providing minimum interference with a line of sight through the open area between the side support columns 11 and 12. In the illustrative embodiment of FIG. 1, the electrical outlet panel 30 has been adjusted to have a top edge coinciding with the upper surface of the shelf 32 for the sake of convenience and to minimize interference with communications through the center area of the column.

Figure 6:
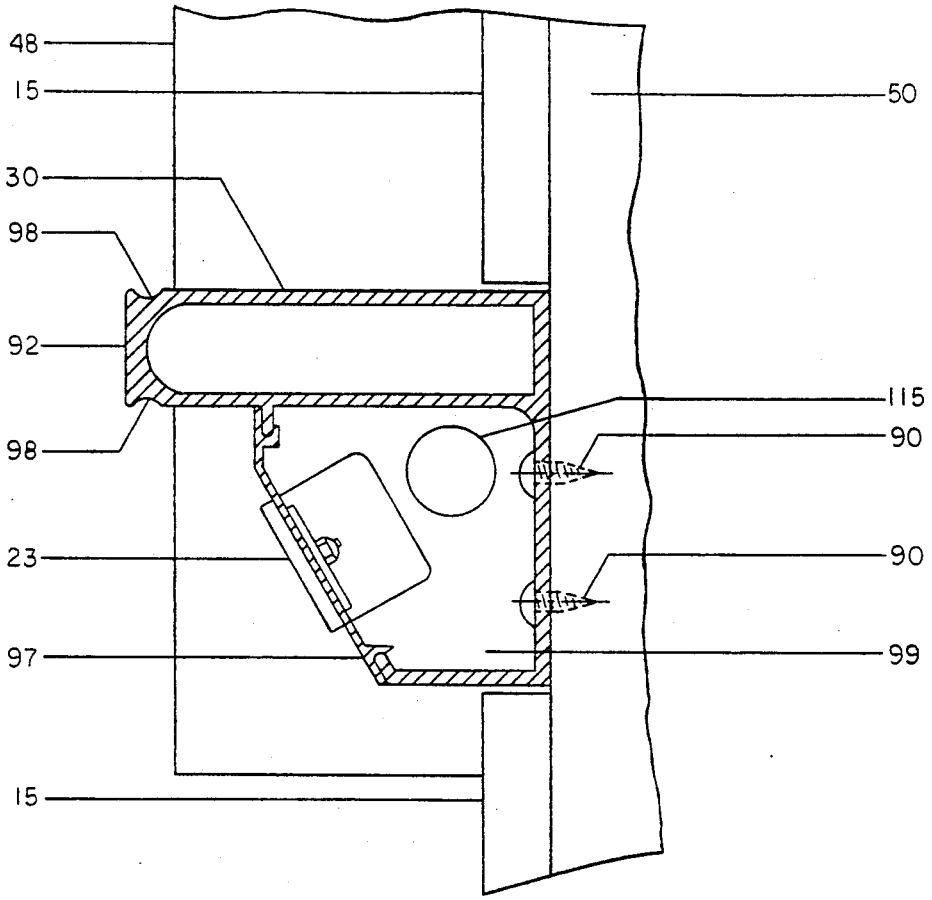
FIG. 6 is a cross-sectional view of a power rail taken along line 6—6 of FIG. 1.

A rear outlet panel 24 supplies electrical power at the rear side of the column. A cross-sectional view of an electrical power outlet panel 30 taken along line 6—6 of FIG. 1 is shown in FIG. 6. The outlet panel is attached to vertical struts 50 by means of standard fasteners 90. Channel sections 15 extend above and below outlet panel 30. The panel includes a housing 99 for containing electrical wiring (not shown) having an opening 115 communicating with electrical wiring housing 48. Receptacle 23 mounted in front panel 97. The power panel 30 is provided with a front edge 92 comprising grooves 98 adapted to accept a clamp similar to clamp 55 shown in FIG. 7, for supporting medical devices on the power outlet panel. Power raceway 35 is mounted to the front side of column 10 in a manner similar to outlet panel 30.

A gas supply rail 44 provides medical gas at the support column 10. The gas rail 44 may, for example, be fluid flow rail such as disclosed in U.S. Pat. No. 4,498,693 infra. It may be attached to an inner side of rear vertical struts 50 by means of clamps similar to clamp 55 shown in FIG. 7 or as shown in the aforementioned patents. The gas supply rail 44 contains parallel conduits in a side-by-side position to present a relatively flat profile to a line of vision in the horizontal direction through the open area between the side frames.

Electrical power and medical gases are supplied to the medical support column structure 10 via housings such as the electrical wiring housings 46 and 48 and the covered gas-feed housing 47. Electrical wiring housing 46 extending from the ceiling, provides electrical power to outlet panel 24 on the rear side of the medical column 10 and housing 48 provides a path for electrical wiring to outlet panel 30 and power raceway 35 on the front side of the support column structure 10. The gas-feed housing 47 provides for extending gas lines from the ceiling to a medical gas rail 44 to provide medical gas supply form the medical support column.

For the sake of appearance, panels 19 and 20 may be attached to the front and back and left and right sides of the lower portion of the column structure extending downward from the lower shelf 32. The front panel, in this embodiment, is conveniently used to support a number of commercial available grounding jacks 21 for receiving grounding leads from medical equipment or personnel as required during a procedure. Internally, the grounding jacks will connect to a ground wire (not shown) in electrical wiring housing 48.

Figure 2:
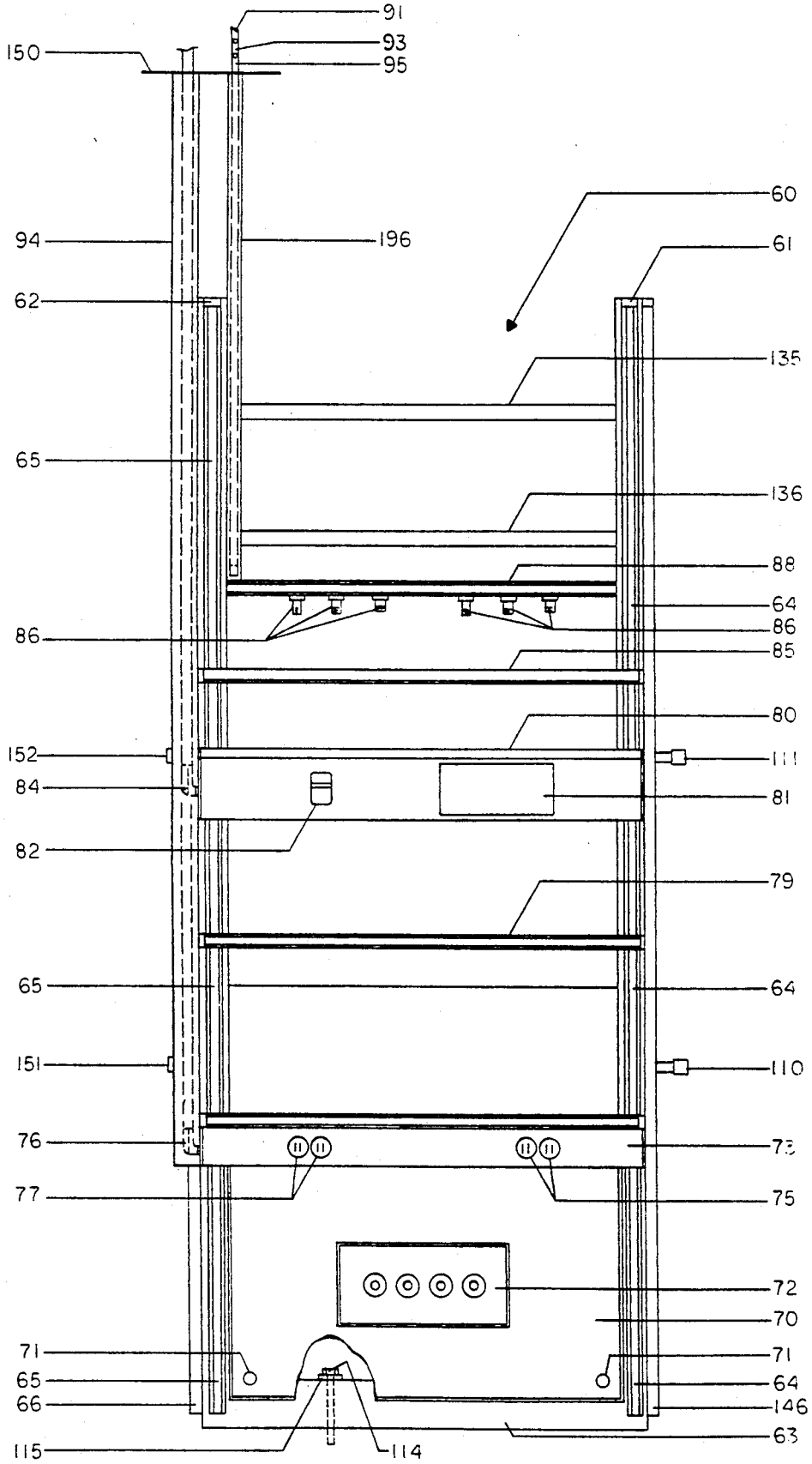
FIG. 2 is a front view of the medical support column of FIG. 1 absent the medical equipment shown in FIG. 1.
Figure 3:
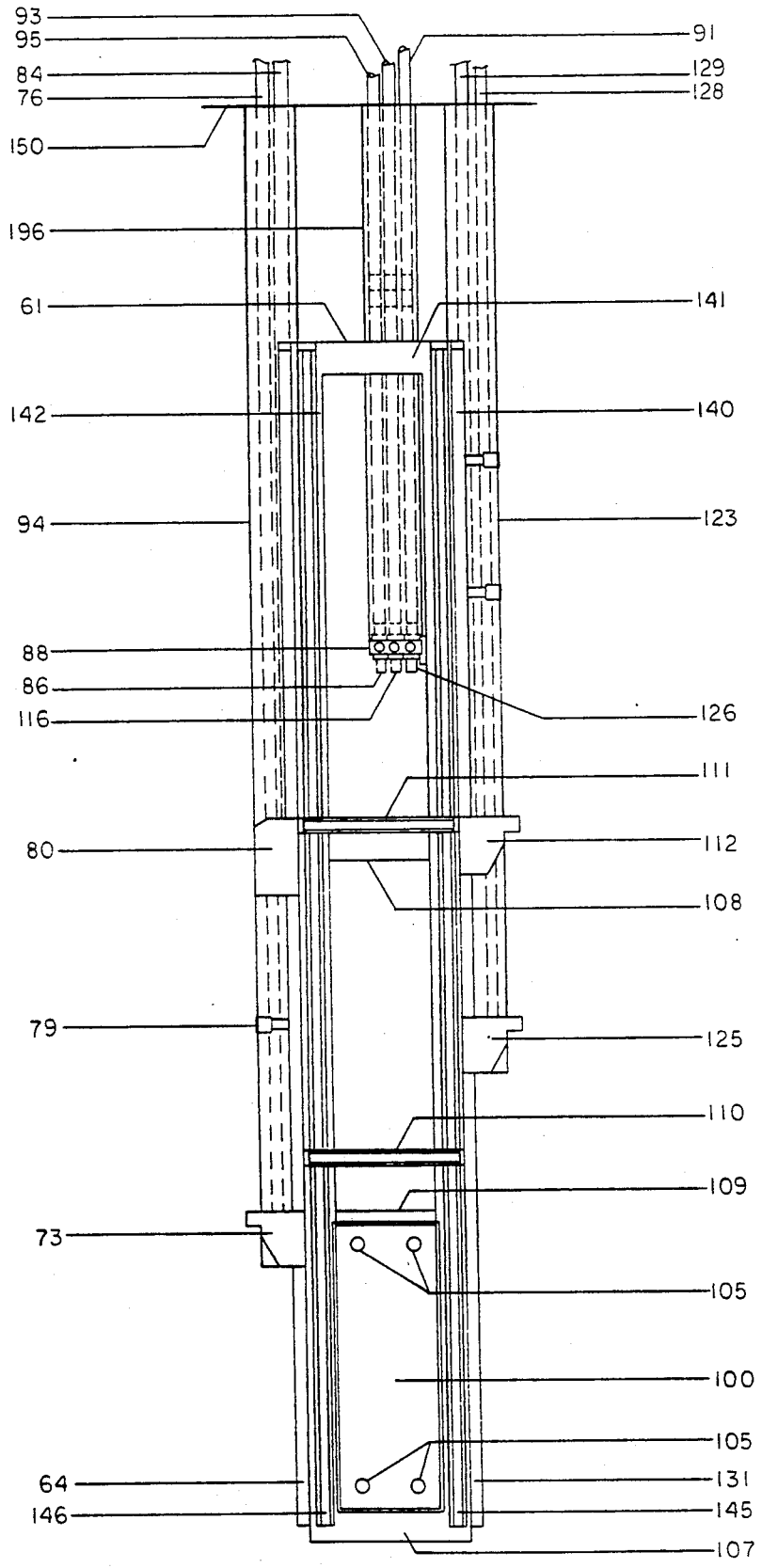
FIG. 3 is a right side elevation of the column of FIG. 2.
Figure 4:
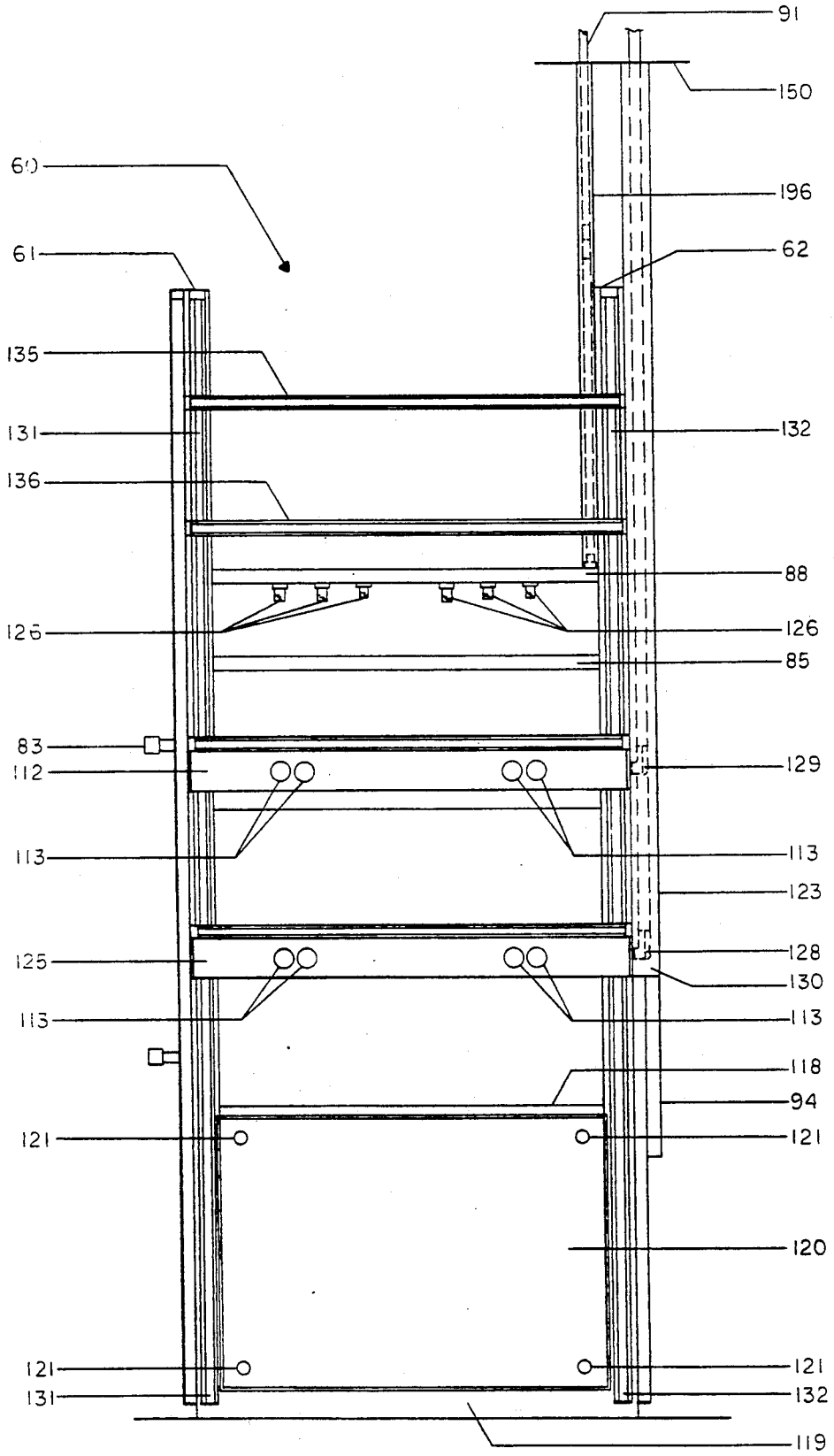
FIG. 4 is a rear elevation of the column of FIG. 2.

FIG. 2 is a front view of a medical support column structure in accordance with the invention more clearly showing structural details. FIGS. 3 and 4 are right side and rear elevations, respectively, of that column. The medical support column structure 60 comprises the vertically extending side frames 61 and 62, comprising vertical struts (140, 142) interconnected by cross members (141, 108, 109). The frames 61, 62 are attached to a base comprised of front horizontal cross member 63, back horizontal cross member 119 (FIG. 4), right horizontal cross member 107 (FIG. 3) and a left horizontal cross member (not shown). In the illustrative embodiment of the invention, the structure 60 is constructed of rectangular cross section hollowed struts and cross members fabricated from 16 gauge cold-rolled steel. The base is attached to the floor upon which the column 60 stands by means of several attachment bolts extending through the base cross members into the floor. One bolt 114 and a washer 115, extending through cross member 63, are shown by way of example in cut-away view in FIG. 2. Extending along the front edge of the side frames 61 and 62 are mounting channels 64 and 65, respectively, which slidably support the rails 79 and 85. Outlet panel 73 having electrical outlets 75 and 77 is mounted on the front edges of frames 61 and 62. An electrical power raceway 80 is similarly mounted on the front edges of frames 61 and 62. Electrical wiring is provided from connections above ceiling 150 via conduit 76 to the outlet panel 73 and to raceway 80 via conduit 84. Conduits 76 and 84 and are contained within the housing 94. Electrical raceway 80 is provided with holes 81 and 82 to accommodate code-blue and nurse-call facilities as shown, for example, in FIG. 1. A medical gas rail 88 is attached to the open side frames 61 and 62 and provides a plurality of gas outlets 86 and 87. The gas rail 88 comprises three horizontally extending, side-by-side gas conduits which receive the medical gases through a plurality of pipes 91, 93. 95 contained within a gas feed housing 196.

A front panel 70, in which are mounted a plurality of grounding jacks 72, is attached to base strut 63 by means of fasteners 71 and similar fasteners near the top part of the plate 70 attached to a cross member (not shown in the drawing) extending between the side frames 61 and 62. A similar plate 120 is shown in FIG. 4 attached to base strut 119 and cross member 118 extending between frames 61 and 62 along the back of the medical support column structure 60. A plate 100, shown in FIG. 3, is attached to cross members 109 and base strut 107 by means of fasteners 105. A similar plate may be used to cover the lower portion of the medical support column structure 60 along its left side (not shown in the drawing). Along the back of the medical column structure 60, shown in FIG. 4, additional electrical outlet panels 112 and 125 are supported, provided with electrical outlets 113. The outlet panel 112 is provided with electrical power via conduit 129 and panel 125 is provided with electrical power via conduit 128. Both of the conduits are contained within the housing 123. Support rails 135 and 136 may be provided for supporting medical equipment on the back of the structure in the manner similar to that shown on the front of the medical support column structure in FIG. 1. Mounting channels 131 and 13 adjustably support support bars 135 and 136. Further shown in the back view of FIG. 4 are six medical gas connectors 126, representing six of a total of 18 outlet connectors supplied by three gas pipes 91, 93 and 95, shown in FIG. 3. The gas pipes are covered by the housing 196 extending down from the ceiling 150. As can be seen in FIG. 4, the gas rail 88 is attached to an inside surface of vertical strut 140 of the right side column 61 and is similarly attached to the rear vertical strut (not shown in the drawing) of the left side frame 62 in a manner described earlier herein with respect to FIG. 1.

The electrical wiring housings 94 and 123 are rectangularly shaped having one narrow dimension and a wider dimension, to allow conduits to be positioned side by side along the wider dimension. The housings 94 and 123 are positioned adjacent side frame 61 with the wider dimension extending in the front to back direction. This construction minimizes interference with critical contact between individuals positioned in front and back of the medical column structure. The housings 94 and 123 have openings at the top thereof to receive electrical conduits or wiring from a ceiling area 150. Housing 94 is provided with openings in its lower section communicating with corresponding openings in power outlet panel 73 and power raceway 80. Similarly, housing 123 is provided with openings in its lower sections communicating with corresponding openings in power outlet panel 112 and 125. Gas feed housing 196 is rectangularly shaped to accommodate gas pipes in a side-by-side relation and is positioned adjacent to side support column 62 to present minimal blocking of the view through the spatial area between the side frames. Housing 196 is provided with a top opening to receive gas pipes from a ceiling area 150 and has a lower opening communicating with medical gas supply rail 88.

Mounting channels 145 and 146 are disposed on the outer edges of the right side frame 61 to adjustably support equipment support rails as desired. Shown in FIG. 3 are support rails 110 and 111 which may be used to support medical equipment, such as medical equipment 45 shown in FIG. 1. Similar mounting channels, e.g., channel 66 shown in FIG. 2, are provided on the outside edges of the left side frame 62 to adjustably mount support bars 151 and 152 depicted in partial end elevation in FIG. 2.

It will be understood that the embodiments described herein are only illustrative of the principles of the invention and that numerous other arrangements may be devised by those skilled in the art without departing from the spirit and scope of this invention.

We claim:

1. A medical equipment support column structure providing dual-sided access and open space for communication between persons positioned on opposite sides of said column, said structure comprising:

a pair of rectangularly-shaped, elongated side frames extending in an upward direction, each of said frames comprising a pair of vertically extending struts, each of said frames having frame cross members connecting said vertically extending struts at an upper end and at a lower end of each of said struts, thereby defining open center areas in said frames, said struts each having an exterior surface facing outwardly of said open center areas;

a pair of generally horizontally extending interconnecting cross members rigidly connecting said two frames together to define an open space between said frames and at an upper portion thereof;

at least one equipment support rail for supporting medical equipment;

a pair of generally vertically extending mounting channels, each attached to one of said strut exterior surfaces along one side of said column; and a connector for supporting said rails on said mounting channels for vertical movement therealong, said support rails extending between said mounting channels for adjustable vertical positioning of said rails along said mounting channels;

whereby medical equipment can be adjustably supported on said column support structure external to said open center areas and extended to said open space between said side frames.

2. The structure in accordance with claim 1 and further comprising an electrical power outlet panel mounted on said frames and extending between said frames, and comprising at least one electrical outlet for supplying electrical power from said medical support column structure.

3. The structure in accordance with claim 2 and further comprising electrical wiring housing for containing electrical wiring, said housing having an opening for communicating with said electrical outlet panel and extending generally vertically along one edge of one of said frames whereby said housing minimally interferes with visible communications across said open space.

4. The structure in accordance with claim 3, wherein said housing has an elongated cross section and said housing is positioned along said one edge of said one of said frames such that a longer edge of said elongated cross section extends in a direction substantially parallel to said frame cross members.

5. The structure in accordance with claim 2 and further comprising an electrical raceway mounted in a generally horizontal orientation between said frames and comprising a front panel and at least one emergency call button mounted in said front panel.

6. The structure in accordance with claim 2 wherein said power outlet panel has a front panel comprising an outer edge for supporting medical equipment thereon.

7. The structure in accordance with claim 1 wherein two of said interconnecting cross members are vertically spaced from each other along front and rear portions of said structure.

8. The structure in accordance with claim 7 and further comprising a shelf extending horizontally in said open space and supported by one pair of interconnecting cross members.

9. The structure in accordance with claim 7 and further comprising a medical gas-feed rail attached to said two frames, said gas-feed rail comprising a plurality of gas lines positioned side by side in a generally horizontal plane extending into said open space between said frames and a plurality of gas line outlets for supplying medical gas from said medical support column structure.

10. The structure in accordance with claim 9 and further comprising a gas pipe housing for enclosing medical gas supply pipes and having an opening communicating with said gas feed rail, said gas pipe housing extending vertically along one edge of one of said frames, whereby said housing minimally interferes with communications across said open space.

11. The structure in accordance with claim 10 wherein said gas pipe housing comprises an elongated cross section and said gas pipe housing extends along said one edge of said one of said frames such that a longer edge of said elongated cross section extends in a direction generally parallel to said cross members interconnecting said vertically extending struts of said side frames.

12. The structure in accordance with claim 1 and further comprising an additional pair of generally vertically extending substantially parallel mounting channels attached to said exterior surfaces of other of said struts and at least one other support rail for supporting medical equipment mounted on said additional pair of mounting channels for adjustable vertical positioning of said at least one other support rail external to said open center areas and extended to said open space between said side frames.

13. The structure in accordance with claim 12 and further comprising a first electrical outlet panel extending generally horizontally between said frames along said one side of said structure and comprising at least one electrical outlet for supplying electrical power from said one side of said structure, and a second electrical outlet panel mounted in a generally horizontal position between said frames along said another side and comprising at least one electrical outlet for supplying electrical power from said another side of said structure.

14. The structure in accordance with claim 13, and further comprising a first electrical wiring housing for enclosing electrical wiring, said housing having an opening communicating with a corresponding opening in said first electrical outlet panel and a second electrical wiring housing for enclosing electrical wiring and having an opening communicating with an opening in said second electrical outlet panel, said first and said second electrical housing each having an elongated cross section and each extending generally vertically along one edge of one of said frames such that a longer edge of said elongated cross section of each of said housings extends in direction substantially parallel to said side frame cross members.

15. The structure in accordance with claim 14 wherein said first and second electrical housings are mounted on said exterior surfaces and disposed external to said open center areas and said open space between said frames.

16. The structure in accordance with claim 9 and further comprising at least one gas flow metering device supported on said at least one equipment support rail for connection to said gas line outlets and for metering medical gas flow from said outlets.

17. The structure in accordance with claim 4 wherein said housing is mounted on one of said exterior surfaces and disposed external to said open center areas and said open space between said side frames.

18. The structure in accordance with claim 1 wherein each of said struts has two of said exterior surfaces and wherein at least one vertically extending mounting channel is attached to each of said two exterior surfaces of at least one of said pair of struts, one of said mounting channel is disposed on said one side of said column support structure and another of said mounting channels is disposed on another side of said column support structure.

19. The structure in accordance with claim 18 wherein at least one vertically extending mounting channel is attached to one of said exterior surfaces of a third of said struts and disposed on said another side of said column support structure and at least one other equipment support rail is mounted for vertical movement on said another of said mounting channels attached to said at least one strut and on said mounting channel attached to said third strut for supporting medical support equipment on said another side of said column support structure external to said open center areas and said open space between said frames.

20. The structure in accordance with claim 1 and further comprising an additional pair of vertically extending mounting channels disposed on another side of said support column structure opposite said one side and at least one additional equipment support rail mounted for vertical adjustment on said additional pair of mounting channels on said another side of said support structure opposite said one side.

* * * * *